United States Patent [19]

Konomi et al.

[11] 3,960,118

[45] June 1, 1976

[54] AIR-FUEL RATIO ADJUSTING DEVICE IN AN INTERNAL COMBUSTION ENGINE HAVING A CARBURETOR

[75] Inventors: Toshiaki Konomi, Susono; Hiroshi Koide, Okazaki, both of Japan

[73] Assignee: Toyota Jidosha Kogyo Kabushiki Kaisha, Toyota, Japan

[22] Filed: May 15, 1974

[21] Appl. No.: 470,304

[30] Foreign Application Priority Data

May 16, 1973 Japan ..... 48-53525

[52] U.S. Cl. ..... 123/32 EA; 60/276; 123/127

[51] Int. Cl.[2] ..... F02B 3/00; F02D 1/06

[58] Field of Search ..... 123/32 EA, 179 G, 127; 60/276

[56] References Cited

UNITED STATES PATENTS

| | | | |
|---|---|---|---|
| 2,355,090 | 8/1944 | Love | 60/276 |
| 3,548,792 | 12/1970 | Palmer | 123/32 EA |
| 3,631,843 | 1/1972 | Yeiser | 123/32 EA |
| 3,704,702 | 5/1972 | Aono | 123/179 G |
| 3,738,341 | 6/1973 | Loos | 60/276 |
| 3,768,259 | 10/1973 | Carnahan | 60/276 |

*Primary Examiner*—Charles J. Myhre
*Assistant Examiner*—Ronald B. Cox
*Attorney, Agent, or Firm*—Stevens, Davis, Miller & Mosher

[57] ABSTRACT

An air-fuel ratio adjusting device in an internal combustion engine having a carburetor, comprising an oxygen sensor whereby oxygen concentration in the exhaust gas is detected and control means whereby the detected oxygen concentration is compared with the air-fuel ratio in the mixture and an output signal corresponding to the difference therebetween is produced, the output signal being applied to an electromagnetic fuel injection system provided in the carburetor. A regulator is provided between the main fuel supply system and the electromagnetic fuel injection system in the carburetor. Also, a cold start nozzle which is controlled on engine starting is provided in the intake system.

1 Claim, 7 Drawing Figures

AIR-FUEL RATIO ADJUSTING DEVICE IN AN INTERNAL COMBUSTION ENGINE HAVING A CARBURETOR

BACKGROUND OF THE INVENTION

1. Field of the Invention

This invention relates to an air-fuel adjusting device in an internal combustion engine in which fuel supplied from a main nozzle in the carburetor is injected by a separately provided, solenoid energized valve nozzle such that the air-fuel ratio in the mixture will be adjusted into the theoretical air-fuel ratio.

2. Description of the Prior Art

In order to purify exhaust gas released from vehicles, an attempt is first made to neutralize the NOx with a reducing catalyst and then to purify the CO and HC by mixing secondary air into the exhaust gas while using oxidative catalysts. Generally, a reducing catalyst demonstrates high exhaust gas-purifying efficiency when the air-fuel ratio in the mixture is close to the theoretical ratio, so that it is desirable that the air-fuel ratio be controlled accurately to stay close to the theoretical ratio. Also, if the air-fuel ratio in the mixture is controlled precisely to remain close to the theoretical ratio, it is possible to remove the pollutants of CO, HC and Nox at one time with the use of a single catalyst. There are proposed means for mechanically controlling the air-fuel ratio in the mixture to keep it close to the theoretical ratio, but there is a certain limitation to the precision of such control means. Also, the use of an electronic control type fuel injection system makes the entire mechanism complicated and costly.

SUMMARY OF THE INVENTION

The present invention provides an air-fuel ratio adjusting device in an internal combustion engine, comprising an oxygen sensor located in the exhaust system of the engine to generate a signal proportional to the air-fuel ratio in the mixture, and a control unit which receives the signal and generates a signal for regulating the air-fuel ratio in the mixture to the theoretical ratio, thereby controlling fuel injection from the solenoid energized valve nozzle to properly correct the lean mixture supplied from the main fuel supply nozzle.

DETAILED DESCRIPTION OF THE PREFERRED EMBODIMENTS

Figure 1:
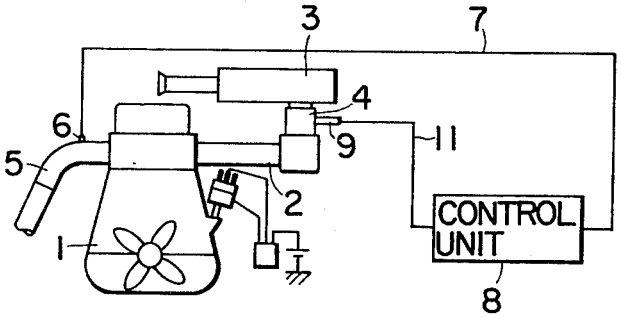
FIG. 1 is a schematic diagram of an internal combustion engine adapted with an air-fuel adjusting device according to the present invention.

An air-fuel ratio adjusting device according to the present invention will now be described with reference to FIG. 1. The air-fuel mixture is supplied into the engine 1 through the air cleaner 3, carburetor 4 and intake manifold 2, and exhaust gas from the engine 1 is released into the atmosphere through exhaust pipe 5. In the exhaust pipe 5 is provided an oxygen sensor 6 adapted to detect the amount of oxygen contained in the exhaust gas, and an output signal from the sensor 6 is transmitted through a conductor 7 into a control unit 8. This control unit 8 is connected by a conductor 11 to a magnet coil 10 (FIG. 2) of a solenoid energized valve nozzle 9 provided in the carburetor 2 so that the output signal from the control unit 8 will be applied to the solenoid energized valve nozzle 9. The amount of oxygen in the exhaust gas indicates whether the air-fuel ratio in the mixture is richer or leaner in fuel than the theoretical air-fuel ratio, so that the control unit is operated according to the variation of the amount of oxygen, thereby either increasing or decreasing fuel injection from the solenoid energized valve nozzle 9.

Figure 2:
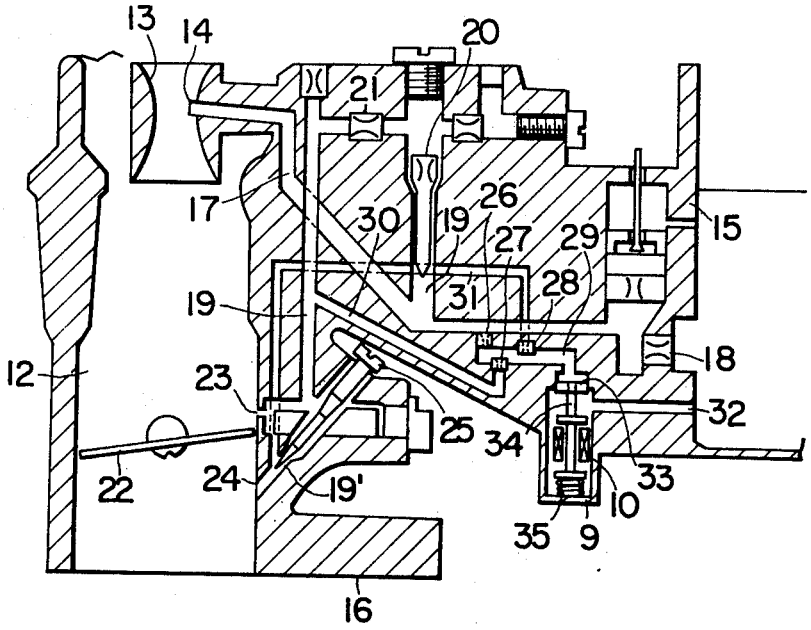
FIG. 2 is a sectional view of the carburetor, showing the essential elements of the present invention.

The carburetor 4 is described in further detail with reference to FIG. 2. A Venturi 13 is provided in the mixture passage 12, and a nozzle 14 opens into the Venturi 13 to supply fuel to the latter from the float chamber 15 through a passage 17 provided in the carburetor 16. Fuel supplied to the nozzle 14 is always controlled to keep the air-fuel ratio leaner than the theoretical air-fuel ratio regardless of the running condition of the engine. A primary main jet 18 is provided in the passage 17 to properly maintain the fuel supply from the float chamber 15 into the passage 17. A passage 19 branches off from a halfway point of the passage 17, the passage 19 being connected via a primary slow jet 20 and a slow economizer jet 21 to slow port 23 and idle port 24 opening into the mixture passage 12 near the throttle valve 22. The fuel flow rate in the idle port 24 is adjusted by an idle adjust screw 25. The passage 17 connected to the nozzle 14, the passage 19 connected to the slow port 23 and the passage 19' between the idle port 24 and idle adjust screw 25 are also connected with passages 29, 30 and 31 which are provided with distribution jets 26, 27 and 28, respectively, adapted to pass a pertinent amount of fuel so that the passages 17, 19 and 19' also will be supplied with fuel from the passages 29, 30 and 31, respectively. These passages 29, 30 and 31 are connected to the solenoid energized valve nozzle 9 which communicates with the float chamber 15 through a passage 32. The solenoid energized valve nozzle 9 comprises a jet port 33, a needle 34, a spring 35 and a magnet coil 10 and is controlled by the control unit 8 to communicate the passage 32 with the passages 29, 30 and 31.

Figure 3:
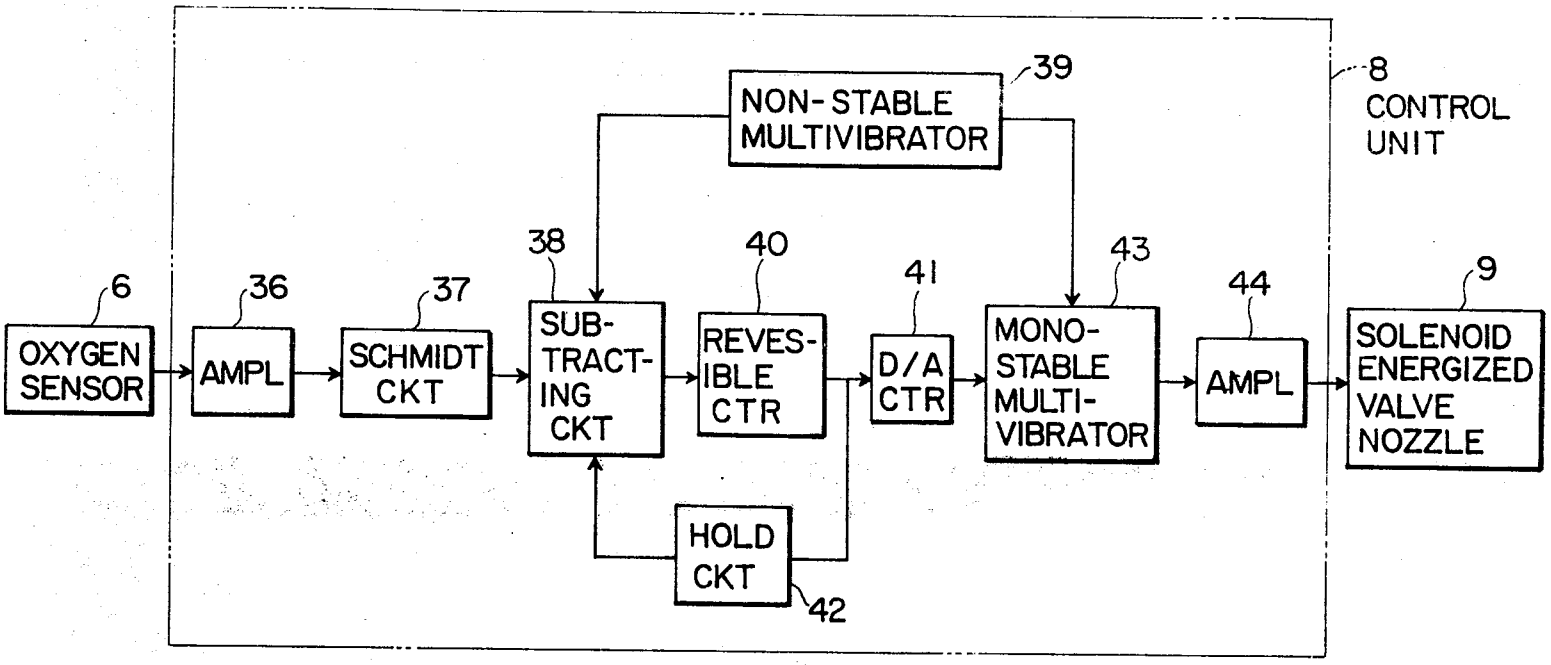
FIG. 3 is a flow chart of the control unit in the air-fuel ratio adjusting device.
Figure 4:
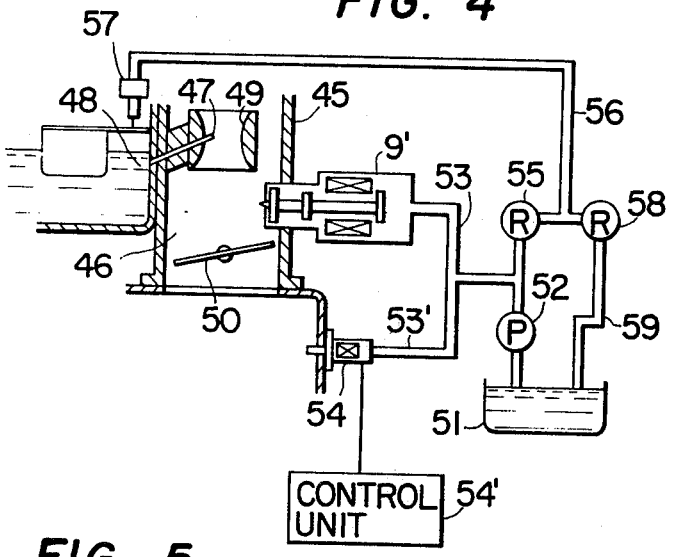
FIG. 4 is a schematic diagram of an internal combustion engine according to another embodiment of the present invention.

The control unit 8 will now be described in detail with reference to FIG. 3. The signal from the oxygen sensor 6 is received by an amplifier 36 wherein the signal is amplified and applied to a Schmidt circuit 37. In the Schmidt circuit 37, the input signal is regulated in its wave form, and if the mixture is richer than the theoretical air-fuel ratio, the signal is converted into the theoretical amount 1, and if the mixture is leaner than the theoretical ratio, the signal is converted into the theoretical amount 0, and such digital output signal is applied to an adding and subtracting circuit 38. This adding and subtracting circuit 38 is arranged such that the sample rate is determined by the oscillation frequency of a non-stable multivibrator 39, so as to judge whether the output signal from the Schmidt circuit 37 is 1 or 0. That is, judgment is made on whether the air-fuel ratio in the running condition of the engine is higher or lower than the theoretical ratio, and it is accordingly decided whether the fuel supply from the solenoid energized valve nozzle 9 should be increased or decreased. The signal from circuit 38 is sent to a reversible counter 40 which performs a summing operation when fuel is to be increased and performs a subtracting operation when fuel is to be decreased. The signal from counter 40 is applied to a D/A converter 41. A hold circuit 42 is provided such that when full bit condition is reached during operation, such full bit condition is maintained no matter how much further the summing operation is performed, and such that when the 0 bit is reached, the 0 bit condition is maintained regardless of any further subtraction. The D/A converter 41 functions to convert an input signal, which is in the form of a binary amount, into an analog voltage amount, and its signal is sent to a mono-stable multivibrator 43. This mono-stable multivibrator 43 is driven by the non-stable multivibrator 39. The rectangular waveform pulse width of the mono-stable multivibrator 43 is determined by the output voltage of the D/A converter 41, with the signal thereof being sent to an amplifier 44. The amplifier 44 amplifies the input signal and forwards it to the magnet coil 10 of the solenoid energized valve nozzle 9. In this case, the rectangular waveform width of the mono-stable multivibrator 43 corresponds to the valve opening period of the nozzle, and if the oscillation frequency of the non-stable multivibrator 39 is constant, fuel supply from the solenoid energized valve nozzle 9 is proportional to the valve opening period. That is, if the air-fuel ratio in the mixture supplied into the engine 1 is leaner than the theoretical ratio, the valve opening period of the solenoid energized valve nozzle 9 is increased. If the mixture is still lean, the valve opening period is further incrementally increased in a stepwise manner until the optimum air-fuel ratio is obtained. When the mixture is rich, the above-stated operation is reversed.

In the air-fuel ratio adjusting device having the above-described arrangements, oxygen concentration in the exhaust gas from the engine is recorded zero when the air-fuel is richer in fuel than the theoretical ratio, but the oxygen concentration is raised as the air-fuel ratio becomes leaner. Thus, when such air-fuel ratio is rich, the oxygen sensor 6 shows a higher voltage than indicated at the theoretical ratio, and when the air-fuel ratio is lean, the sensor shows a lower voltage than indicated at the theoretical ratio. The signal from the oxygen sensor 6 is applied to the amplifier 36 of the control unit 8, and then from the amplifier 44 a valve opening or valve closing signal is sent to the magnet coil 10 of the solenoid energized valve nozzle 9 through the respective circuits. The amount of fuel supplied by the solenoid energized valve nozzle 9 is proportional to $Ao \Sigma t/T$ where $Ao$ is the passage area of the jet port 33, and $\Sigma t/T$ is the total valve opening period per unit time $T$. Thus, it will be understood that the jet port 33 performs the same function as a variable throttle.

If the oxygen sensor 6 has just detected that the air-fuel ratio in the mixture is leaner than the theoretical ratio, then the control unit 8 will send to the magnet coil 10 a signal for opening the valve of the solenoid energized valve nozzle 9. Consequently, the needle 34 opens the jet port 33 to supply fuel in the float chamber 15 to the passages 17, 19 and 19' through passage 32, jet port 33 and respective distribution jets 26, 27 and 28, and then further to the nozzle 14, slow port 23 and idle port 24. On the other hand, if the oxygen sensor 6 detects that the air-fuel ratio in the mixture is richer than the theoretical ratio, the solenoid energized valve nozzle 9 is closed and hence fuel is supplied from the float chamber 15 to the passages 17, 19 and 19' only through the primary jet 18.

Another embodiment of the present invention now will be described with reference to FIGS. 4, 5, 6 and 7.

Figure 5:
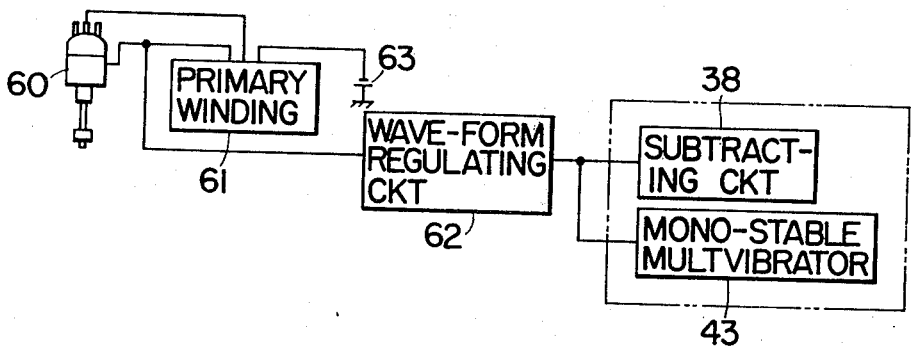
FIGS. 5 and 6 are drawings showing different forms of a control signal generating mechanism.
Figure 6:
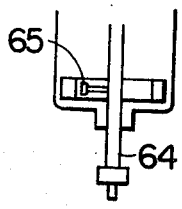
Figure 7:
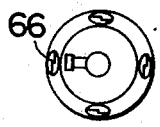
FIG. 7 is a cross-sectional view of the mechanism of FIG. 6.

A Venturi 47 is provided in the mixture passage 46 of the carburetor 45, and a nozzle 47 opens into the Venturi for supplying fuel from the float chamber 48. A throttle valve 50 is provided downstream of the Venturi 49 in the mixture passage 46, and a solenoid energized valve nozzle 9' is disposed between the Venturi 49 and the throttle valve 50. Fuel is supplied to the solenoid energized valve nozzle 9' from a fuel tank 51 through a passage 53 by the operation of a pump 52. A passage 53' branches off from the passage 53 for supplying fuel to a cold start nozzle 54 provided in the intake manifold 2 downstream of the throttle valve 50. At the start of the engine, a signal is applied to the cold start nozzle 54 from the control unit 54' and fuel is injected into the intake manifold 2. The passage 53 is connected to a passage 56 provided with a regulator 55, with the other end of the passage 56 being connected to a needle valve 57 provided in the float chamber 48. The passage 56 is also connected to the fuel tank 51 by a passage 59 provided with a regulator 58 in its way. In this way, fuel pressure (for example 2 kg/cm$^2$) between the pump 52 and the regulator 55 is maintained higher than the fuel pressure (for example 0.25 kg/cm$^2$) in the passage 56. The magnet coil 10 of the solenoid energized valve nozzle 9' is controlled by the control unit 8 in the same way as described in the preceding embodiment, but in this case, instead of using the non-stable multivibrator 39, the interrupted voltage of the primary winding 61 of the distributor 60 is regulated in wave form by a wave-form regulating circuit 62, with a battery 63 being used as power source, as shown in FIG. 5. It is also possible to mount a permanent magnet 65 to the shaft 64 of the distributor 60 so as to make an on-off operation of reed switch 66 as shown in FIGS. 6 and 7, thereby producing a signal.

In the air-fuel ratio adjusting device of this embodiment, as in that of the preceding embodiment, the solenoid energized valve nozzle 9' is opened or closed by the operation of the oxygen sensor 6. In this embodiment, however, fuel supplied to the solenoid energized valve nozzle 9' is raised to pressure by the pump 52, and fuel is injected directly into the mixture passage 46 from said nozzle 9'. The cold start nozzle 54 is also supplied with high pressure fuel, and at start of the engine, the control unit 54' is operated in response to the start switch to inject fuel from the cold start nozzle 54. Fuel supplied into the passage 56 from the regulator 55 is controlled in its pressure by the regulator 58 and flows into the float chamber 48, with superfluous fuel being returned into the fuel tank 51 through the regulator 58. As for the means for applying the signals to the adding and subtracting circuit 38 and mono-stable multivibrator 43, since the engine speed changes until it reaches the level of about 1 : 10, the solenoid energized valve nozzle 9' is operated positively by the distributor 60. Generally, in an internal combustion engine for automobiles, the flow rate of fuel into the carburetor changes within the range of about 1 : 50 for both extremities. Usually, the nozzle does not operate positively if the valve opening period is less than 0.002 seconds, so that it needs to make the maximum valve opening period of the nozzle longer than 0.1 second.

However, it is impossible with the non-stable multivibrator 39 to raise the maximum frequency over 10 Hz, so that the valve opening operation of the nozzle would sometimes become insecure.

As described above, according to the air-fuel ratio adjusting device of the present invention, a fuel-air mixture which is leaner than the theoretical air-fuel ratio is supplied from a nozzle provided in the Venturi, and the control unit is operated by an oxygen sensor which detects the air-fuel ratio so as to inject fuel from a magnet valve nozzle to adjust the air-fuel ratio in the mixture at the theoretical value, so that the fuel-air mixture fed into the engine is positively maintained at the theoretical air-fuel ratio. Also, the present device is simple in structure and further, fuel with different pressures is supplied to the float chamber in the carburetor and to the solenoid energized valve nozzle by the operation of a single pump. Moreover, since fuel is injected from a cold start nozzle at the start of the engine, cold start of the engine is remarkably improved.

What we claim is:

1. An air-fuel ratio adjusting device for use in an internal combustion engine having a carburetor including a main fuel supply system, comprising:

an oxygen sensor provided in the exhaust system of said internal combustion engine for detecting oxygen concentration in the exhaust gas;

a control unit connected to said oxygen sensor including means for comparing the air-fuel ratio in the air-fuel mixture in the engine with the theoretical air-fuel ratio through the detected oxygen concentration and generating a control signal corresponding to the difference between the engine air-fuel ratio and the theoretical air-fuel ratio, and means for continuously generating a pulse signal with a time interval initiated in response to the engine rotation, the pulse width of said pulse signal being varied in response to said control signal;

an electromagnetic fuel injection system provided separately from said main fuel supply system in the carburetor, and having a solenoid valve means energized by said varied pulse signal of said control unit;

a first passage connected to said fuel injection system at its one end and connected to a fuel tank at its other end;

a second passage connected to said main fuel supply system at its one end and divided at its other end into two passages, one of which is connected to the fuel tank and the other of which is connected to said first passage;

a pump provided in said first passage at a position between the fuel tank and the point of connection of said first and second passages; and regulator means including a first regulator provided in said divided passage of said second passage which is connected to said first passage, and a second regulator provided in said divided passage of said second passage which is connected to the fuel tank, whereby said regulators cause said pump to deliver fuel at different pressure to said main fuel supply system and said fuel injection system.

* * * * *